US005312050A

United States Patent [19]

Schumann et al.

[11] Patent Number: 5,312,050

[45] Date of Patent: May 17, 1994

[54] ELECTROMAGNETIC FUEL INJECTOR

[75] Inventors: David R. Schumann, Rochester; Steven L. Good, Canandaigua, both of N.Y.; Paul B. Rissi, Grand Rapids; Leman F. Reus, Rockford, both of Mich.

[73] Assignee: General Motors Corporation, Detroit, Mich.

[21] Appl. No.: 55,340

[22] Filed: May 3, 1993

[51] Int. Cl.[5] ..... F02M 51/00

[52] U.S. Cl. ..... 239/585.1; 239/585.3; 239/600; 251/129.18

[58] Field of Search ..... 239/585.1, 585.3–585.5, 239/600; 251/129.16, 129.18

[56] References Cited

U.S. PATENT DOCUMENTS

| | | | |
|---|---|---|---|
| 3,731,881 | 5/1973 | Dixon et al. | 239/585.3 |
| 3,738,578 | 6/1973 | Farrell | 239/585.4 |
| 4,360,161 | 11/1982 | Claxton et al. | 239/585.4 |
| 4,515,129 | 5/1985 | Stettner | 123/472 |
| 4,572,436 | 2/1986 | Stettner et al. | 239/585.3 |
| 4,678,124 | 7/1987 | Hafner et al. | 239/585.3 |
| 5,000,420 | 3/1991 | Hendrixon et al. | 251/129.18 |
| 5,012,982 | 5/1991 | Souma et al. | 239/585.4 |
| 5,070,845 | 12/1991 | Avdenko et al. | 123/470 |
| 5,082,184 | 1/1992 | Stettner et al. | 239/408 |
| 5,217,047 | 6/1993 | McCabe | 251/129.18 |

FOREIGN PATENT DOCUMENTS

| | | | |
|---|---|---|---|
| 698160 | 11/1964 | Canada | 251/129.18 |
| 13267 | 1/1982 | Japan | 239/585.4 |

*Primary Examiner*—Karen B. Merritt

*Attorney, Agent, or Firm*—Karl F. Barr, Jr.

[57] ABSTRACT

An electromagnetic fuel injector for use in an internal combustion engine has a center pole piece with an axially extending bore which slidingly accepts an adjusting pin therein. The adjusting pin has a first end portion for engagement with the armature return spring of the injector. Axial translation of the adjusting pin, relative to the center pole piece will vary the compression on the spring, the seating load on the armature valve and, as such, the dynamic flow characteristic of the injector. The adjusting pin further has means for engaging the center pole piece to rotate the piece which is threadingly engaged within the injector housing. Rotation of the threaded piece relative to the housing varies the armature/valve travel and, as such, the static flow characteristic of the injector.

4 Claims, 5 Drawing Sheets

ELECTROMAGNETIC FUEL INJECTOR

TECHNICAL FIELD

The invention relates to an electromagnetic fuel injector and, in particular, to such an injector having an integral adjusting pin for calibrating both dynamic and static flow.

BACKGROUND OF THE INVENTION

Various types of electromagnetic fuel injectors are used in the fuel injection systems of internal combustion engines. Such injectors, as well as other solenoid controlled valve structures, have been used which have incorporated therein a solenoid armature that is located between the pole piece of the solenoid and a fixed valve seat whereby the armature operates as a valve member. Examples of such electromagnetic fuel injectors or solenoid controlled valve structures are described in U.S. Pat. Nos. 4,515,129 issued May 7, 1985 to Stettner and 4,572,436 issued Feb. 25, 1986 to Stettner et. al. The above identified patents show arrangements in which an armature/valve is biased to a normally closed position against a fixed valve seat by a spring member. The armature/valve is operable between a seated, sealing position against the valve seat and an open position against a pole piece of the solenoid for controlling flow through a flow passage in the valve seat.

It is desirable to precisely control the flow of fuel through the valve seat, and thus the injector, in order to meet performance requirements, as well as, emissions regulations for internal combustion engines. It is also desirable that, for a given application, all injectors will meter equivalent quantities of fuel to the engine cylinders upon application of a predetermined electrical input. As such, the injector flow curve must be adjusted to meet a given set of nominal flow requirements. In general the injector is a linear device that will meter fuel on a per-pulse basis which is proportional to the input. The specific relationship between pulse-width and fuel delivered is dependent upon the static flow of the injector, which is typically controlled through armature stroke, and dynamic response or flow, which is typically controlled through armature spring load. Setting the static and dynamic flow requirements in injectors has presented the manufacturer with concerns of contamination, durability and accuracy since calibration normally occurs during assembly, requiring further handling subsequent to flow adjustment.

SUMMARY OF THE INVENTION

The present invention relates to an electromagnetic fuel injector for use in an internal combustion engine. The subject injector includes a housing means having an axial bore therethrough with an injector base fixed in the bore at one end of the housing and a solenoid assembly fixed in the bore at the other end of the housing in spaced apart relationship to the injector base by means of a spacer ring to thereby define therewith a fuel chamber adapted to be supplied with fuel from a source. The injector base is provided with a valve seat surface having a fuel passage therethrough for the discharge of fuel from the injector. Flow through the valve seat in the injector base is controlled by an armature/valve member whereby axial movement of the armature/valve member between the valve seat surface and the working surface of the solenoid assembly allows fuel to flow from the fuel chamber through the fuel passage and out of the injector.

Armature/valve stroke, that is the distance that the armature/valve travels between the valve seat and the working surface of the pole piece of the solenoid assembly, is a controlling factor in setting the static flow through the valve. The spring force applied to seat the armature/valve against the valve seat controls the rate at which the armature/valve opens for any given pulse-width and therefore affects the dynamic flow through the injector. The solenoid assembly of the present invention has a threaded pole piece with a stepped axial bore therethrough which, when threadingly inserted into the solenoid assembly, extends into the fuel chamber. The stepped bore of the pole piece contains a valve return spring which is biased against the armature/valve by an adjustment pin inserted into the opposite end of the bore. The adjustment pin provides for rotation of the threaded pole piece to set static flow through the injector and also moves axially to vary spring force against the armature/valve thereby setting the dynamic flow through the injector. Access locations in the injector body facilitate mechanical fixing of the threaded pole piece to the injector body following adjustment of static flow and the adjustment pin to the injector body following adjustment of the dynamic flow.

The adjustment pin operates externally of the fuel flow path of the injector thereby allowing complete assembly of the injector prior to flow calibration. In addition, the access locations for the mechanical staking process, as well as the adjustment pin are positioned outside of the fuel flow path to facilitate calibration in a dry, solvent free environment.

Other objects and features of the invention will become apparent by reference to the following description and to the drawings.

DESCRIPTION OF THE PREFERRED EMBODIMENT

Figure 1:
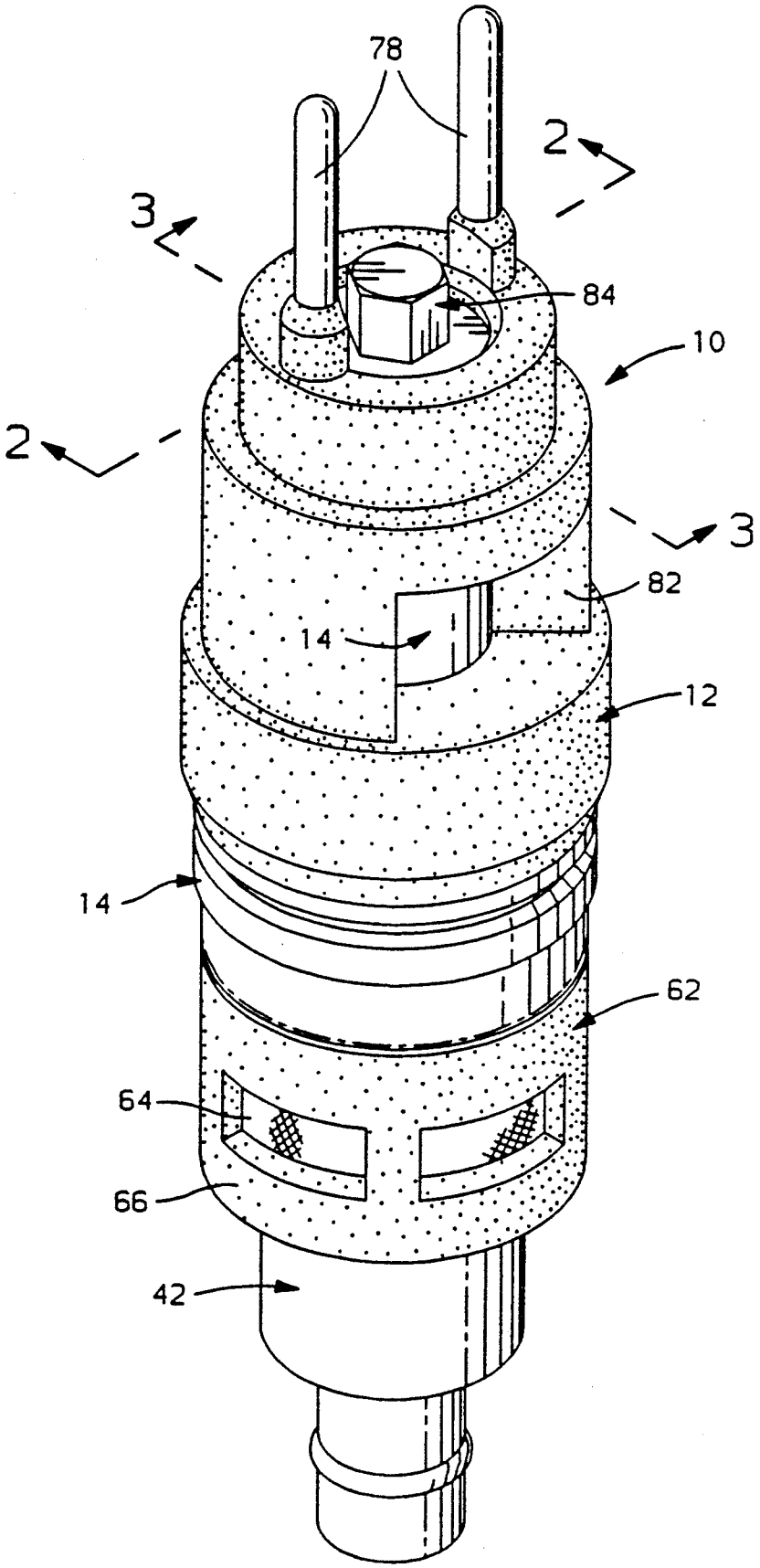
FIG. 1 is a perspective view of an electromagnetic fuel injector embodying features of the present invention.

Referring first to FIGS. 1–4, the electromagnetic fuel injector, generally designated as 10, in accordance with a preferred embodiment of the invention has a body assembly 12 comprising an outer body or housing 14 provided with a stepped axial bore therethrough whereby to define an upper wall 16 having a partially threaded portion 18, an intermediate wall 20 connected to the upper wall by shoulder 22, and a lower wall 24 connected to the intermediate wall 20 by shoulder 26 with the walls 16, 20, 24 defining progressively increasing internal diameters of the axial bore through housing 14.

A solenoid assembly 28 is slidingly received within the intermediate wall 20 and is positioned within body 14 by the shoulder 22. The solenoid assembly 28 includes a coil 30 partially encased in an insulative material 32 and a center pole piece 34 having a tubular configuration with a stepped inner bore, and a partially threaded outer surface, the threaded outer portion engageable with the threaded portion 18 of the inner wall portion of the upper wall 16 of the body 14. An annular lower portion 36, FIG. 4, of the center pole piece 34 extends axially below the coil, as viewed in FIGS. 2, 3 and 4, with the axial position of the pole relative to the coil determined by rotation of the threaded pole piece 34. The inner bore 38 of the center pole piece 34 further includes a hex shaped upper portion 40, as viewed in the direction of FIGS. 2 and 3, for mating engagement with one end of an injector adjusting pin to be described in further detail below.

Figure 2:
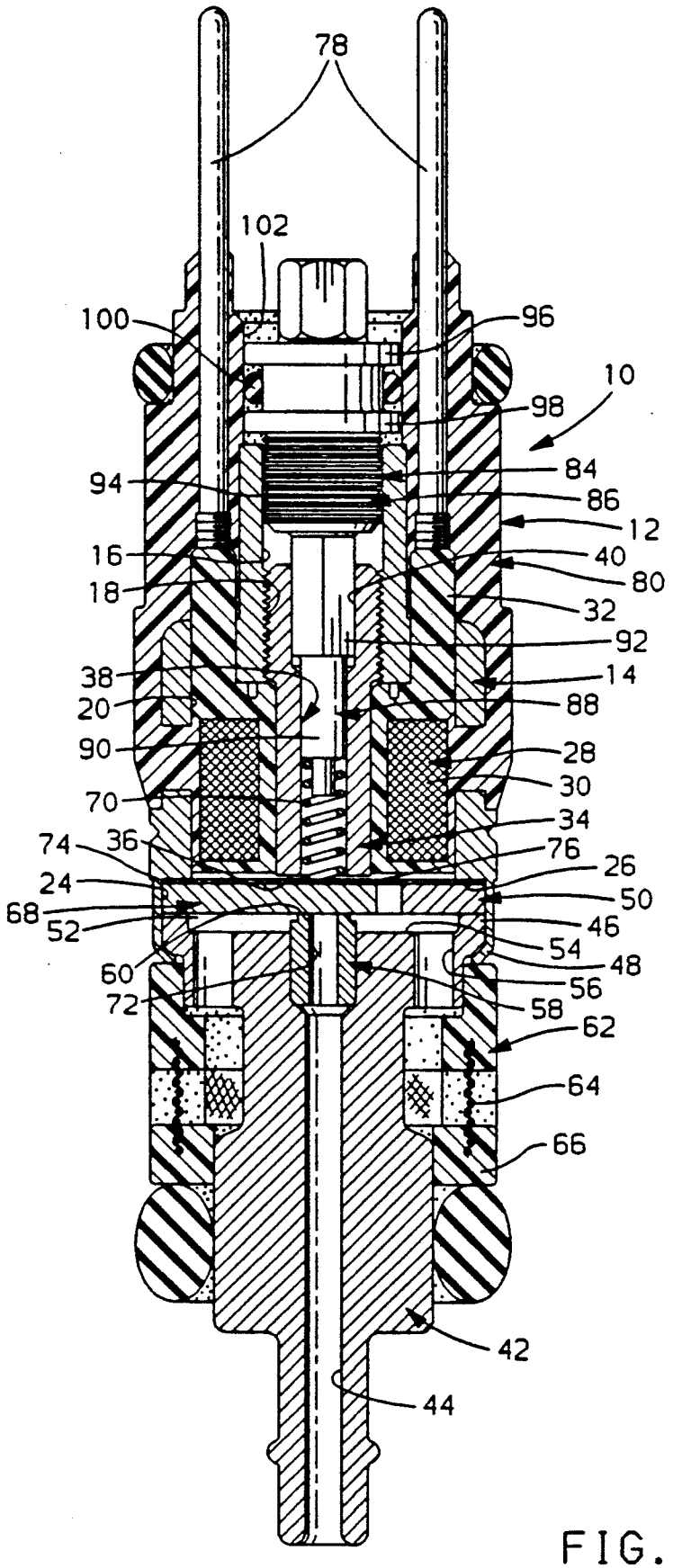
FIG. 2 is a longitudinal cross-sectional view of the electromagnetic fuel injector of FIG. 1, taken along line 2—2 of FIG. 1.
Figure 3:
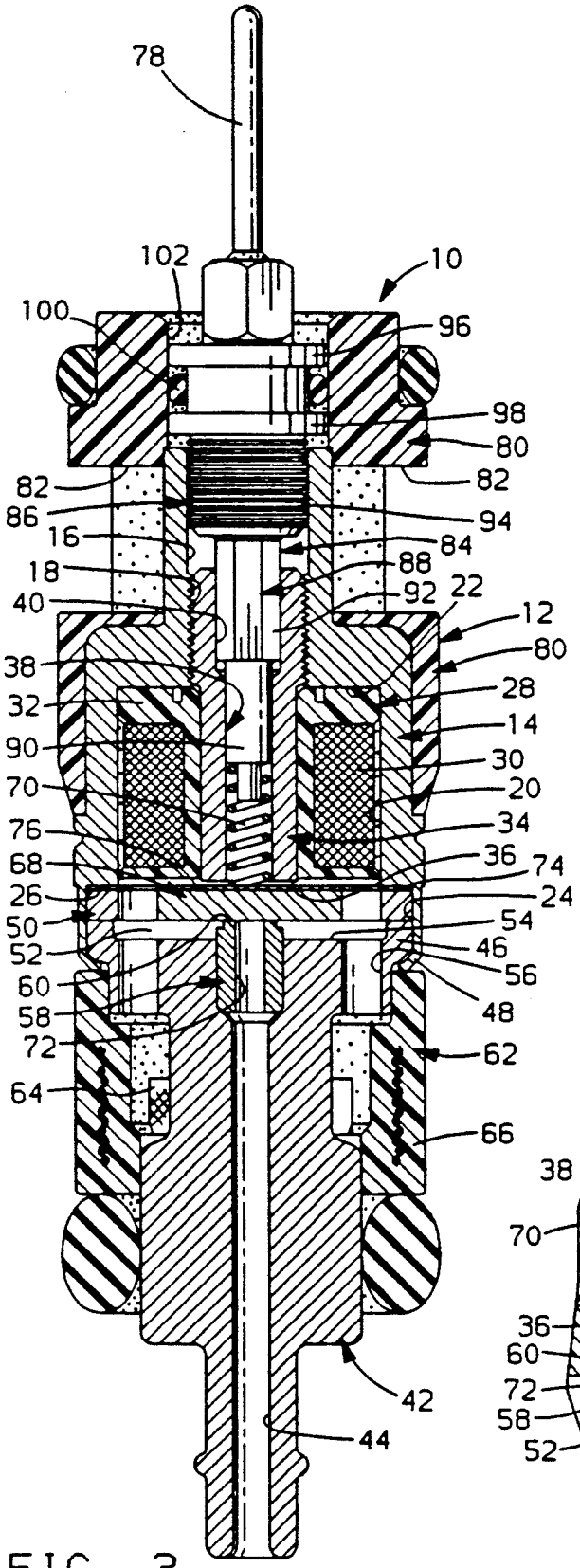
FIG. 3 is a longitudinal cross-sectional view of the electromagnetic fuel injector of FIG. 1, taken along line 3—3 of FIG. 1.

Disposed within and closing the lower wall portion 24 of housing 14 is a fuel distributor body 42. As illustrated in FIGS. 1, 2 and 3, the distributor body 42 has a stepped outer surface and a through bore 44. The stepped outer surface comprises an upper land portion 46 which defines an outer shoulder 48 about which lower wall 24 is crimped thereby sealing the lower end of the fuel injector body 14. The land portion 46 supportingly engages the lower surface of a c-shaped spacer ring 50 which is held in position by the land 46 and shoulder 26 of housing 14 thereby establishing a fuel chamber 52 between the coil assembly 28 and the distributor body 42. A recessed region 54 in the upper surface of the distributor body 42, defines one end of fuel chamber 52 and facilitates the flow of fuel from fuel openings 56 extending from the exterior of the distributor 42 into the fuel chamber 52 to a valve seat 58 disposed about the perimeter of through bore 44. The valve seat 58 is preferably an insert which is press fit into through bore 44 having an upper sealing surface 60 which may be machined following insertion so as to define a planar valve seating surface comprising the valve seating surface 60 and the upper surface of land 46 of the distributor body 42. A filtration assembly 62 is preferably disposed about the circumference of the distributor body 42 and comprises a filter medium 64 supported by a flexible polymer frame 66.

Figure 4:
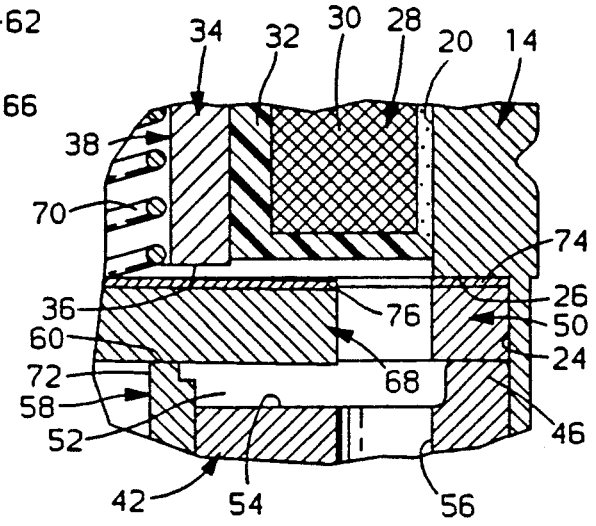
FIG. 4 is an enlarged sectional view.

An armature/valve member 68 is disposed within the fuel chamber 52 and operates to meter the flow of fuel therefrom. The armature/valve 68 is disposed for reciprocal movement between a valve closed position in which the valve, urged by spring member 70, closes fuel passage 72 in valve seat 58 and a valve open position in which solenoid assembly 28 is energized to draw the armature/valve 68 away from valve seat 58 to allow fuel from chamber 52 to flow through bore 44. Preferably, as shown in FIG. 4, a non-magnetic shim 74 is disposed between the c-shaped spacer ring 50 and shoulder 26. The shim 74 has an inwardly extending tongue 76 which is suitably fixed to the upper surface of the armature/valve 68 so as to affect positional indexing of the armature/valve 68 and to control reciprocal motion of the valve while establishing a fixed minimum air gap between the opposed working surfaces of the annular lower portion 36 of the center pole piece 34 and the armature/valve 68.

The coil 30 is adapted to be supplied with electrical power via a pair of terminal leads 78 which extend through shoulder 22 of housing 14 and are partially encased and supported by insulative material 80. The insulative material 80 is preferably a polymeric material. In addition to the support and positioning function of the insulative material with respect to coil 30, the insulative overmolding 80 acts to seal the upper portion of the injector housing 14 against leakage of fuel therefrom. As shown in FIGS. 1 and 3, openings 82 in the overmolding 80 allow access to the outer surface of the upper portion 16 of the housing 14. The openings 82 provide access for staking tooling used during adjustment of the injector during assembly, to be described in further detail below.

Generally, fuel injectors are linear devices that meter fuel on a per pulse basis which is proportional to the inputted pulse width. This specific relationship between pulse width and fuel delivered or metered through the injector is dependent upon the static flow of the injector, which is typically controlled by the stroke of the armature/valve, and the dynamic flow of the injector, which is typically a function of the closing force exerted on the armature/valve. The present injector uses an adjusting pin 84 having a stepped outer surface comprising substantially two portions; a large diameter upper portion 86 and a small diameter lower portion 88. The lower portion 88 has a cylindrical end portion 90 for sliding engagement with the inner bore 38 of the center pole piece 34. The end portion 90 is adapted to engage and position the armature/valve return spring 70 extending between it and the upper surface of the armature/valve member 68. Axial movement of the adjusting pin within inner bore 38 will have the affect of varying the seating force exerted on the armature/valve member 68 thereby allowing adjustment of the dynamic response of the armature/valve member 68 for a given pulse width.

A hex shaped outer surface 92 is disposed on part of the lower portion 88 of the adjusting pin 84. The hex shaped outer surface 92 mates with a corresponding hex shaped opening in the center pole piece 34 establishing a means by which the threaded pole piece may be rotated, relative to the housing. By rotating the pole piece, the lower annular portion 36 may be advanced or retracted, relative to the armature/valve 68, thereby adjusting the distance between the working surfaces of the pole piece and the armature/valve member and, consequently, the stroke and static flow of the injector.

The large diameter upper portion 86 of adjusting pin 84 comprises a cylindrical portion 94, preferably having a knurled surface, for sliding engagement with the upper wall 16 of the housing 14. Above the knurled cylindrical portion 94, as viewed in the Figures, are a pair of flanges 96,98 disposed in axially spaced relationship to each other. A resilient sealing member such as o-ring 100 is seated in the space defined between the two flanges 96,98 and defines a fluid seal between the adjusting pin 84 and the wall 102 defined by encapsulant 80, formed as an extension of upper wall 16 of housing 14. Upper end portion 86 of the adjusting pin 84 has an outer surface configured to engage an adjusting tool. In the embodiment shown in the Figures, the end portion 86 has a hex shaped cross-section.

Figure 5:
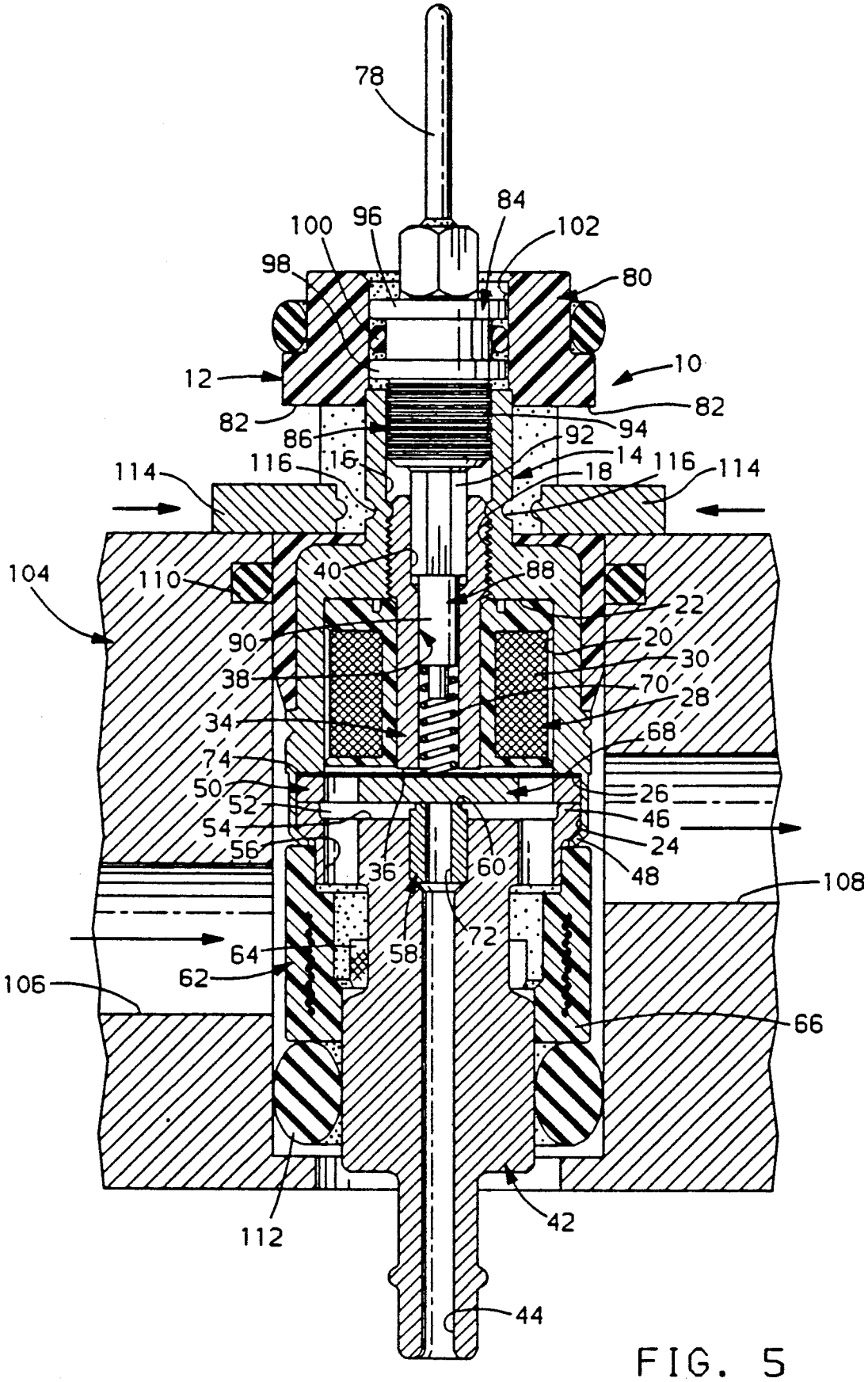
FIG. 5 is a schematic view of the electromagnetic fuel injector of the present invention subject to one step of the flow calibration.
Figure 6:
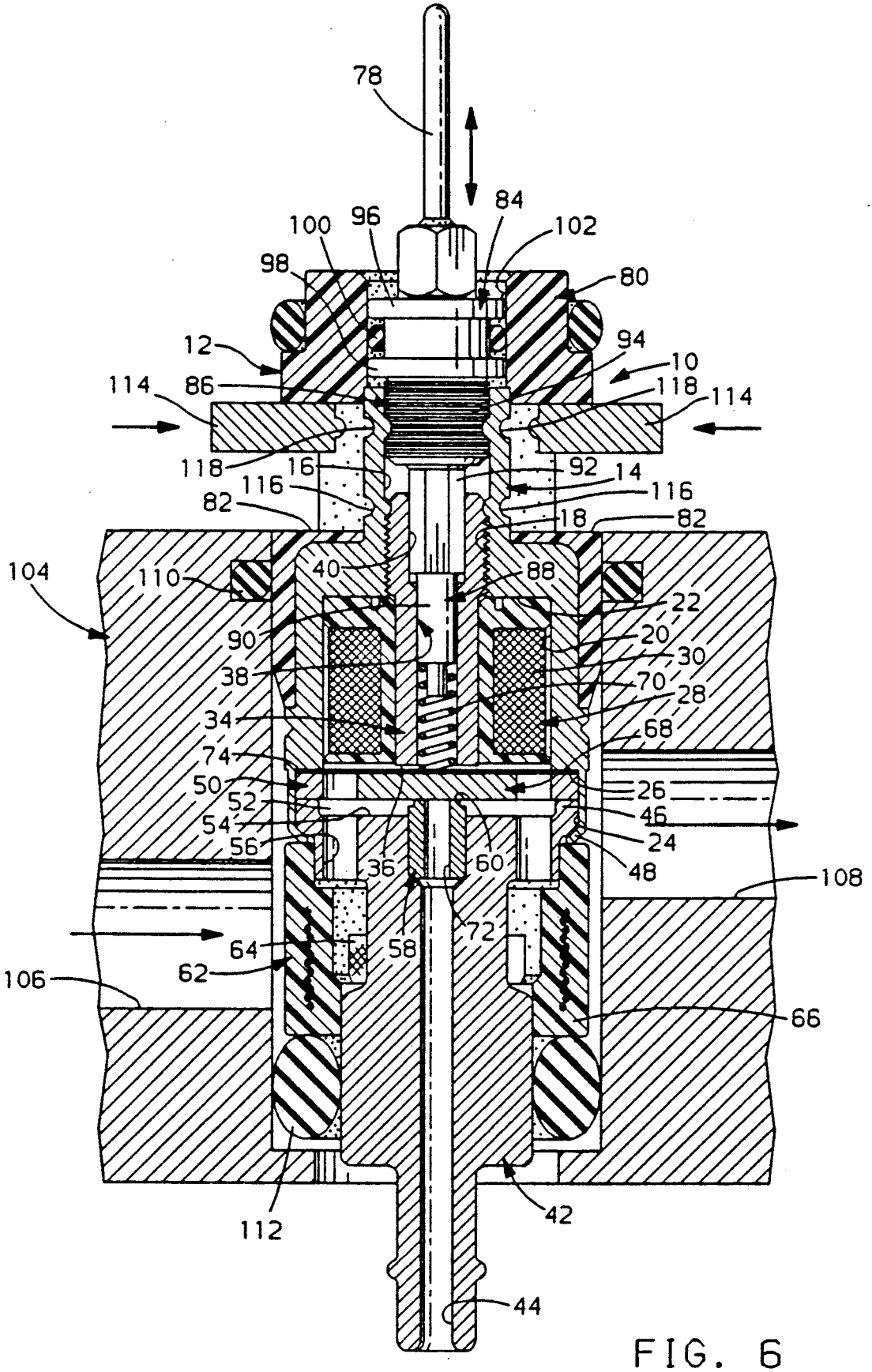
FIG. 6 is a schematic view of the electromagnetic fuel injector of the present invention subject to a second step of flow calibration.

FIGS. 5 and 6 illustrate the electromagnetic fuel injector 10 of the preset invention mounted in a flow fixture 104 for fuel flow adjustment. Pressurized fuel or solvent used for injector calibration is supplied to fuel chamber 52 through fuel inlet passages 56 in distributor body 42. The fuel is supplied by means of a fuel supply passage 106 in fixture 104 which communicates with fuel inlet passages 56 and excess fuel is removed through outlet passage 108. Leakage between the injector and the fixture is prevented by means of resilient sealing members 110, 112 disposed therebetween. With pressurized fuel supplied to the injector 10, the coil 30 is energized so as to draw the armature/valve member 68 off of the valve seat 58 and into abutment with the annular lower portion 36 of the center pole piece 34 thereby allowing fuel to flow through the fuel passage 72 in valve seat 58 and out of the injector through passage 44 in distributor body 42. The flow out of the injector is measured and the total valve lift and, therefore, static flow through the injector 10, is varied by rotating the adjusting pin 84 thereby advancing or retracting the threaded center pole piece 34 with respect to the valve seat 58. Following the adjustment of static flow, a staking tool 114 is inserted into opening 82 in the insulative overmolding 80 at the locations 116 shown in FIG. 5, corresponding to the upper end of the threaded portion of the center pole piece 34. The staking tool applies a radially inwardly directed force on the housing 14 to thereby deform the housing 14 against the center pole piece 34 to thereby complete static adjustment of the injector by preventing further rotation of the adjustable pole piece 34 relative to the threaded portion 18 of the housing 14.

Referring to FIG. 6, with pressurized fuel supplied to the injector 10, the coil 30 is pulse width cycled, and flow through the injector is again measured and adjusted by axially translating the adjusting pin 84 to vary the compression of the armature/valve return spring 70 and, as such, the seating force exerted on the armature/valve 68 by the spring. The spring force adjustment varies the opening and closing response of the armature/valve 68 to set the dynamic flow characteristic of the injector 10. Following the adjustment of dynamic flow, the staking tool 114 is again inserted into the access opening 82 of the insulating overmolding 80 at location 118, corresponding to the knurled cylindrical portion 94 of the adjusting pin. The staking tool again exerts a radially inwardly directed force on the housing 14 to thereby deform the housing against the knurled cylindrical portion 94 of the adjusting pin 84 to thereby complete the dynamic adjustment of the injector 10 by preventing further axial translation relative to the valve seat 58. Due to the encapsulation geometry and placement of the access openings 84, no fluid leak path is present from the flow fixture 104 during calibration. This feature allows calibration and staking operations to take place on the dry side of the calibration unit, greatly simplifying the operation.

The present invention discloses an electromagnetic fuel injector for use in an internal combustion engine having a center pole piece with an axially extending bore which slidingly accepts an adjusting pin therein. The adjusting pin has a first end portion for engagement with the armature return spring of the injector. Axial translation of the adjusting pin, relative to the center pole piece will vary the compression on the spring, the seating load on the armature valve and, as such, the dynamic flow characteristic of the injector. The adjusting pin further has means for engaging the center pole piece to rotate the piece, threadingly engaged within the injector housing. Rotation of the threaded piece relative to the housing varies the armature/valve travel and, as such, the static flow characteristic of the injector.

The present invention further discloses an electromagnetic fuel injector having access to the housing outer surface for staking tools which are used to fix the housing relative to the center pole piece (static flow) and the housing relative to the adjusting pin (dynamic flow). The configuration of the injector and location of the access openings allow calibration after assembly of the injector in a simplified calibration operation.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described were chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. An electromagnetic fuel injector comprising a housing, a coil disposed at one end of said housing and a valve seat disposed at a second end to define a fuel chamber therebetween, said coil positioned within said housing by a polymeric overmolding of a portion of said housing, a center pole piece extending through and below said coil and having an end portion situated within said fuel chamber, an armature/valve member disposed within said fuel chamber, in spaced relationship to said end portion of said center pole piece, for reciprocal movement between a valve closed position in which the armature/valve member engages said valve seat to preclude fuel delivery therethrough and a valve open position in which said coil is energized to draw said armature/valve member off of said valve seat to allow fuel from said chamber to flow therethrough, said center pole piece in threaded engagement with said housing and rotatable to advance and retract said pole piece relative to said coil and said armature/valve member to thereby vary the stroke of said armature/valve off of said valve seat, said center pole piece further comprising an axial bore configured to receive an armature/valve return spring, said spring having a first end in engagement with said armature/valve and a second end in engagement with one end of an adjusting pin, said pin disposed for axial translation within said axial bore of said center pole piece to thereby vary the spring rate of said armature/valve return spring and the dynamic response of said injector upon pulse-width energization of said coil.

2. An electromagnetic fuel injector, as defined in claim 1, said polymeric overmolding having openings which expose portions of said housing located adjacent said center pole piece and said adjusting pin, deformable upon application of external force, to fix said center pole piece relative to said housing and said armature/valve member and to fix said adjusting pin relative to said housing and said armature/valve return spring.

3. An electromagnetic fuel injector comprising a housing, a coil disposed at one end of said housing and a valve seat disposed at a second end to define a fuel chamber therebetween, a center pole piece extending through and below said coil and having an end portion situated within said fuel chamber, an armature/valve member disposed within said fuel chamber, in spaced relationship to said end portion of said center pole piece, for reciprocal movement between a valve closed position in which the armature/valve member engages said valve seat to preclude fuel delivery therethrough and a valve open position in which said coil is energized to draw said armature/valve member off of said valve seat to allow fuel from said chamber to flow therethrough, said center pole piece having an axial bore extending therethrough configured to receive an armature valve return spring, said spring having a first end operable on said armature/valve member and a second end in communication with one end of an adjusting pin, said pin disposed for axial translation within said axial bore of said center pole piece to thereby vary the spring rate of said armature/valve return spring and the dynamic response of said injector upon pulse width energization of said coil, said center pole piece in threaded engagement with said housing and rotatable, through rotation of said adjusting pin, to advance and retract said pole piece relative to said coil and said armature/-valve member to thereby vary the spaced relationship of said armature/valve member relative to said end portion of said center pole piece.

4. An electromagnetic fuel injector, as defined in claim 3, said housing having locations, adjacent said center pole piece and said adjusting pin, deformable upon application of external force, to fix said center pole piece relative to said housing and said armature/-valve member and to fix said adjusting pin relative to said housing and said armature/valve return spring.

* * * * *